US006565195B2

(12) United States Patent
Blair

(10) Patent No.: US 6,565,195 B2
(45) **Date of Patent: *May 20, 2003**

(54) FEED CHANNELS OF A FLUID EJECTION DEVICE

(75) Inventor: Dustin W. Blair, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/057,528

(22) Filed: Jan. 25, 2002

(65) Prior Publication Data

US 2002/0163563 A1 Nov. 7, 2002

Related U.S. Application Data

(63) Continuation-in-part of application No. 09/849,097, filed on May 4, 2001, now Pat. No. 6,346,467.

(51) Int. Cl.[7] ..... B41J 2/05; B41J 2/17
(52) U.S. Cl. ..... 347/65; 347/94
(58) Field of Search ..... 347/63, 65, 93, 347/94, 67

(56) References Cited

U.S. PATENT DOCUMENTS

| | | | | | |
|---|---|---|---|---|---|
| 4,719,477 | A | | 1/1988 | Hess | 347/59 |
| 4,882,595 | A | | 11/1989 | Trueba | 347/85 |
| 5,317,346 | A | | 5/1994 | Garcia | 347/63 |
| 5,519,423 | A | * | 5/1996 | Moritz, III et al. | 347/65 |
| 5,912,685 | A | * | 6/1999 | Raman | 347/65 |

* cited by examiner

*Primary Examiner*—Craig Hallacher
*Assistant Examiner*—Juanita Stephens

(57) ABSTRACT

Volume of fluid feed channels is adjusted for drop generators that are staggered with respect to a feed edge. In one embodiment, barrier islands are positioned, sized, and/or shaped to adjust the volume. In another embodiment, protrusions or walls thereof are positioned to adjust the volume.

29 Claims, 8 Drawing Sheets

FEED CHANNELS OF A FLUID EJECTION DEVICE

CROSS REFERENCE TO RELATED APPLICATIONS

This application is a continuation in part of application Ser. No. 09/849,097, filed May 4, 2001, now U.S. Pat. No. 6,346,467 B1. The disclosure of that application is fully incorporated by reference herein.

BACKGROUND OF THE INVENTION

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994).

Generally, an ink jet image is formed pursuant to precise placement on a print medium of ink drops emitted by an ink drop generating device known as an ink jet printhead. Typically, an ink jet printhead is supported on a movable print carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in a nozzle plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the nozzle plate are aligned with associated ink chambers. Ink drop generator regions are formed by the ink chambers and portions of the thin film substructure and the nozzle plate that are adjacent the ink chambers. The ink drop generators are commonly arranged in columnar arrays that are adjacent respective ink feed edges. For reasons such as timing logic and electrical interconnection, the ink drop generators of a given column are staggered relative to the adjacent ink feed edge, wherein ink chambers are at differing distances from the ink feed edge.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The ink barrier layer is typically a polymer material that is laminated as a dry film to the thin film substructure, and is designed to be photodefinable and both UV and thermally curable. Ink is fed from one or more ink reservoirs to the various ink chambers around ink feed edges that can comprise sides of the thin film substructure or sides of ink feed slots formed in the substrate.

An example of the physical arrangement of the nozzle plate, ink barrier layer, and thin film substructure is illustrated at page 44 of the *Hewlett-Packard Journal* of February 1994, cited above. Further examples of ink jet printheads are set forth in commonly assigned U.S. Pat. Nos. 4,719,477 and 5,317,346.

Considerations with an ink jet printhead having staggered nozzles (heater resistors) include variation in ink drop size along an ink drop generator column which adversely affects print quality.

SUMMARY OF THE INVENTION

In an exemplary embodiment of the invention, a method for ejecting fluid from a device comprising: forming a plurality of fluid drop generators including: a plurality of heater elements located at different distances from a feed edge; a plurality of fluid chambers disposed over the plurality of heater elements, respectively, each fluid chamber defined by opposing walls that extend toward the feed edge; and a plurality of barrier islands each disposed between the opposing walls to define a pair of fluid channels; and selecting the size of the plurality of barrier islands to substantially equalize fluidic resistances in the plurality of fluid chambers.

In another exemplary embodiment, a method for ejecting fluid from a device comprising: forming a plurality of fluid drop generators located at different distances from a feed edge, the plurality of fluid drop generators having a plurality of fluid regions for receiving fluid and a plurality of barrier islands disposed within the fluid regions, respectively; and varying the volume of the plurality of fluid regions by varying the size of the plurality of barrier islands to thereby equalize fluidic pressure in the plurality of fluid regions.

In yet another exemplary embodiment, a fluid ejecting device comprising: a substrate having a feed edge and a plurality of heater elements located at different distances from the feed edge; a barrier layer having a plurality of fluid chambers disposed over the plurality of heater elements, respectively, the plurality of fluid chambers each defined by opposing walls that extend toward the feed edge; and a plurality of barrier islands disposed between the opposing walls, the size of the plurality of barrier islands is selected to substantially equalize the fluidic resistances within the plurality of fluid chambers.

BRIEF DESCRIPTION OF THE DRAWINGS

The advantages and features of the disclosed invention will readily be appreciated by persons skilled in the art from the following detailed description when read in conjunction with the drawings wherein.

DETAILED DESCRIPTION OF THE DISCLOSURE

Figure 1A:
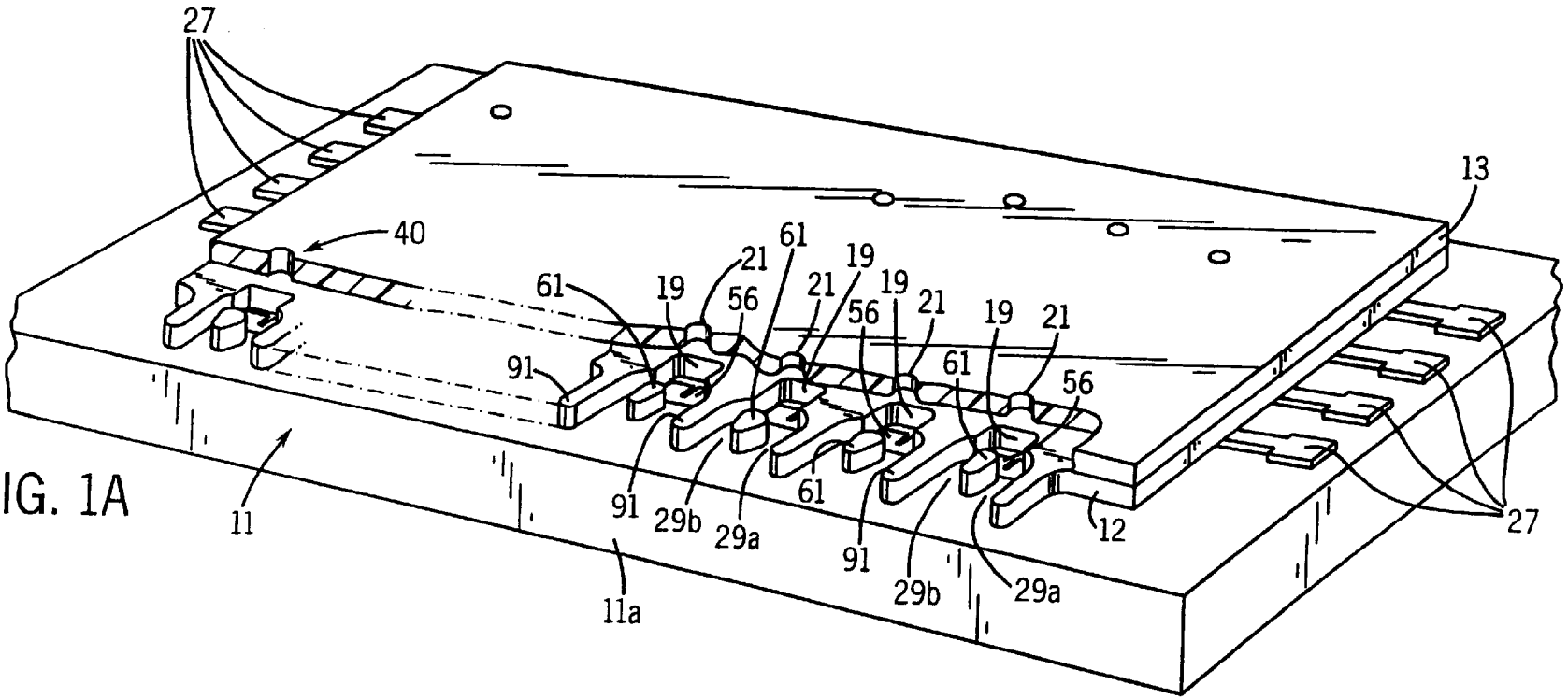
FIG. 1A is a schematic, partially sectioned perspective view of a printhead that employs an embodiment of the invention.

In the following detailed description and in the several figures of the drawing, like elements are identified with like reference numerals.

Referring now to the embodiment of FIG. 1A, set forth therein is an unscaled schematic perspective view of a printhead in which the invention can be employed. In one embodiment, the printhead includes (a) a thin film substructure or die 11 comprising a substrate such as silicon and having various thin film layers formed thereon, (b) a (ink) barrier layer 12 disposed on the thin film substructure 11, and (c) an orifice or nozzle plate 13 attached to the top of the barrier 12. In alternative embodiments, the barrier layer and nozzle plate are combined in a single layer.

The thin film substructure 11 is formed pursuant to integrated circuit fabrication techniques, and includes thin film (firing) heater resistors 56 formed therein. By way of illustrative example, the thin film heater resistors 56 are located in columns along longitudinal (ink) feed edges 11*a* of the thin film substructure 11. Heater resistors 56 are described in this embodiment, but in alternative embodiments other pressure elements may be used such as piezo technology.

In one embodiment, the barrier layer 12 is formed of a dry film that is heated and pressure laminated to the thin film substructure 11 and photodefined to form therein (firing) or fluid chambers 19 and or feed channels 29*a*, 29*b*. Gold bond pads 27 engagable for external electrical connections are disposed at the ends of the thin film substructure 11 and are not covered by the barrier layer 12. By way of illustrative example, the barrier layer material comprises an acrylate based photopolymer dry film such as the Parad brand photopolymer dry film obtainable from E.I. duPont de Nemours and Company of Wilmington, Del. Similar dry films include other duPont products such as the "Riston" brand dry film and dry films made by other chemical providers. The nozzle plate 13 comprises, for example, a planar substrate comprised of a polymer material and in which the nozzles are formed by laser ablation, for example as disclosed in commonly assigned U.S. Pat. No. 5,469,199, incorporated herein by reference. The nozzle plate 13 can also comprise, by way of further example, a plated metal such as nickel.

The fluid chambers 19 in the barrier layer 12 are more particularly disposed over respective heater resistors 56 formed in the thin film substructure 11, and each fluid chamber 19 is defined by the edge or wall of a chamber opening formed in the barrier layer 12. The feed channels 29*a*, 29*b* are defined by further openings formed in the barrier layer 12 and barrier islands 61, and are integrally joined to respective firing chambers 19. In one embodiment, the barrier island, as discussed in detail below, is formed as the same material as the barrier layer.

The nozzle plate 13 includes orifices or nozzles 21 disposed over respective fluid chambers 19, such that a heater resistor 56, an associated fluid chamber 19, and an associated nozzle 21 form a fluid drop generator 40. In one particular embodiment, each printhead has 524 nozzles. There are 262 nozzles arranged along or adjacent to each feed edge 11*a*.

Figure 1B:
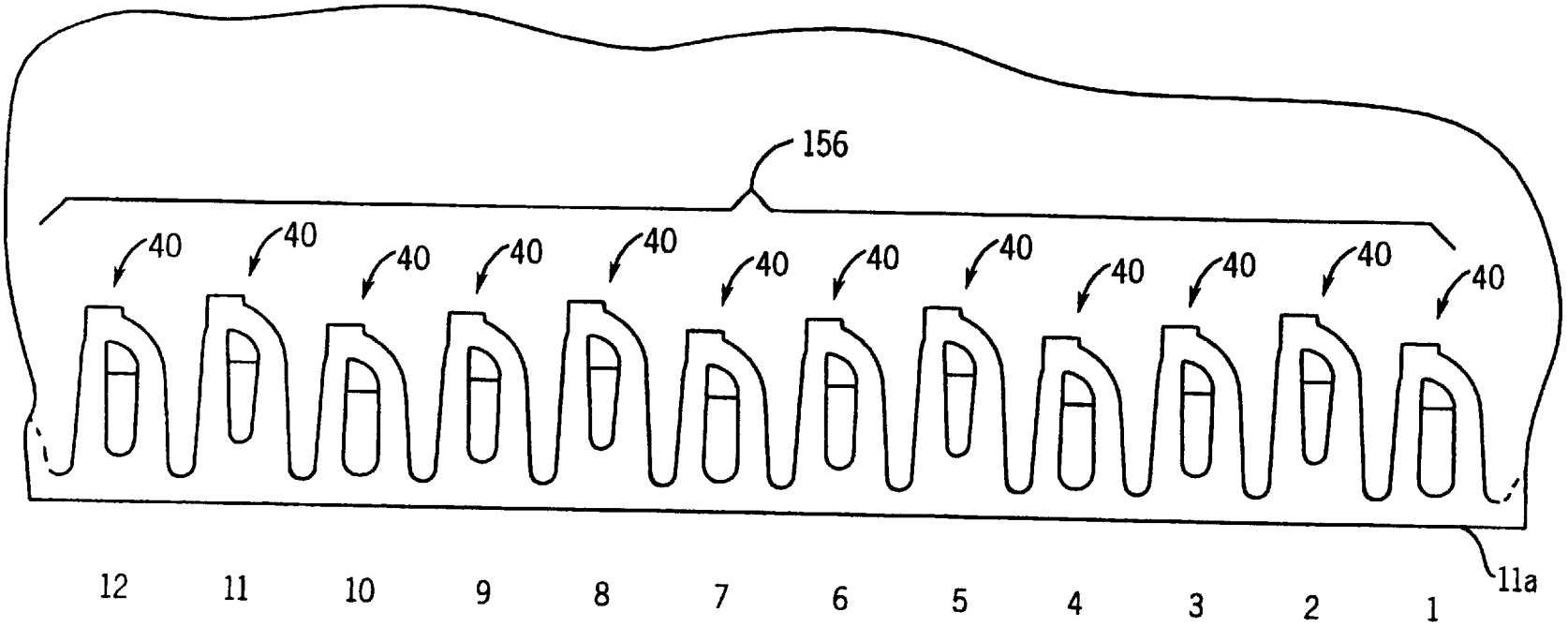
FIG. 1B is a plan view of an embodiment of a group of fluid chambers, heater resistors, feed channels and barrier islands.
Figure 2:
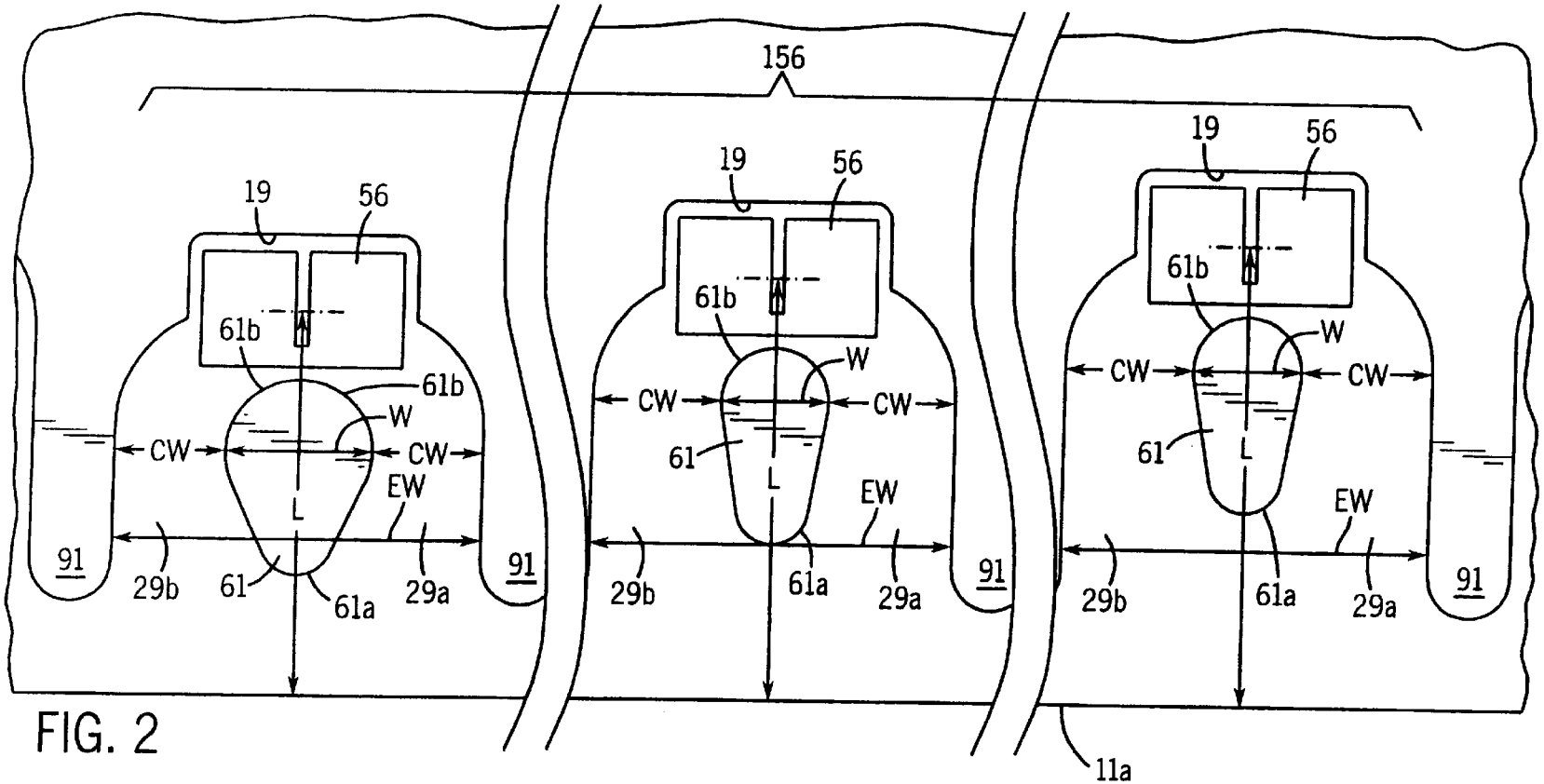
FIG. 2 is an unscaled schematic top plan view illustrating the configuration of a plurality of representative fluid chambers, feed channels, and barrier islands of the printhead shown in FIGS. 1A and 1B.

In the embodiment of FIG. 1B, the heater resistors 56 are arranged in repeating groups 156 of twelve drop generators 40. Each fluid drop generator of a group 156 has a different shelf length L (see FIG. 2) and wherein the shelf length of correspondingly located drop generators in respective groups is substantially the same. In other words, the drop generators have different shelf lengths L, depending on their locations within a group in this embodiment. In a particular embodiment, each sequential heater resistor that is fired has a corresponding shelf length L that incrementally increases within its group. Shelf length L is measured from the fluid feed edge 11*a* to a center of the respective heater resistor (as shown in FIG. 2). For example, the firing sequence of the heater resistors in the group 156 shown in the embodiment of FIG. 1B is:

1, 4, 7, 10, 3, 6, 9, 12, 2, 5, 8, 11.

For example, the shelf length L of resistor 4 is incrementally greater than the shelf length of resistor 1, and the shelf length of 10 is incrementally greater than that of resistor 7, which is incrementally greater than that of resistor 4. In one embodiment, skipping an adjacent resistor (or more) in a firing sequence avoids an undesirable fluid pressure effect in the fluid chamber adjacent the heater resistor 56.

FIG. 2 is an unscaled schematic top plan view illustrating one embodiment of the configuration of three representative fluid chambers 19, including associated feed channels 29*a*, 29*b*, and barrier islands 61 of a group of drop generators 40. The first drop generator (shown to the left) represents a chamber configuration for a shortest length L in the group. The second drop generator (shown center) represents a chamber configuration for an average shelf length L. The third drop generator (shown to the right) represents a chamber configuration for a longest shelf length L in the group.

Figure 3:
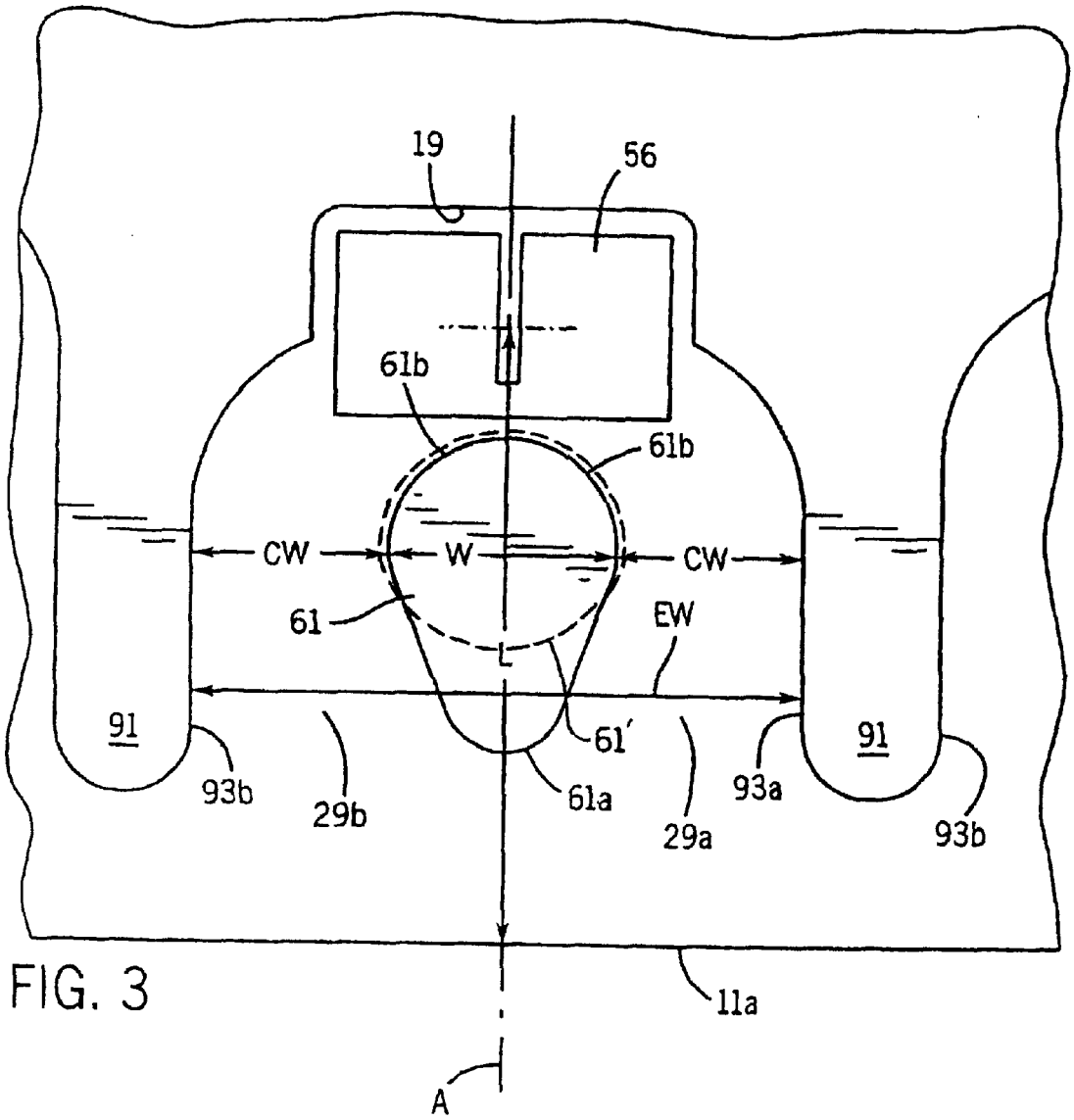
FIG. 3 is an unscaled schematic top plan view of one embodiment of a representative fluid chamber and its associated barrier island and feed channels.

As shown in the embodiment of FIGS. 2 and 3, the feed channels 29*a*, 29*b* within a fluid chamber 19 are formed by walls of barrier protrusions 91 that extend from regions between the heating element 56 and the feed edge 11*a*. Each barrier protrusion 91 more particularly includes walls 93*a*, 93*b* that extend from the fluid chamber 19 toward the feed edge 11*a*. In one particular embodiment, the walls 93*a*, 93*b* of a given protrusion 91 extend toward the feed edge 11*a* and converge (at the bottom of the protrusion 91) toward each other. Thus, the opposing walls 93*a*, 93*b* form outer sides of feed channels 29*a*, 29*b*. In this embodiment, a barrier island 61 is located between opposing walls 93*a*, 93*b* so as to define the feed channels 29*a*, 29*b* which merge into the fluid chamber 19. The distance EW between generally linear portions of such opposing walls 93*a*, 93*a* as measured parallel to the feed edge 11*a* is, illustratively, substantially the same for all fluid chambers in this embodiment.

In this embodiment, the size of each barrier island is more particularly selected to modulate or equalize the fluidic resistances of the channels that are of different lengths for the different shelf lengths. By comparing the three configurations shown in FIG. 2, it can be seen that, for example, in this embodiment the largest dimension W of a barrier island 61 as measured parallel to the feed edge 11*a* may be selected as an inverse function of the shelf length L of the associated chamber. In a particular embodiment the barrier island dimension W is increased as shelf length is decreased. Consequently, in the embodiment of FIG. 2, the channel width CW of each of the associated channels 29*a*, 29*b*, at its narrowest point, increases as the shelf length L of the channel length increases. Channel width CW is thus a direct function of shelf length L. Effectively, the equivalent hydraulic diameter of each of the channels 29*a*, 29*b* is increased in this embodiment as channel length is increased to compensate for the increased fluid flow distances, so that the fluidic resistances of the channels 29*a*, 29*b* for fluid chambers 19 having different shelf lengths (distances between center of heater resistor and feed edge 11*a*) can be substantially maintained at a balanced level throughout the group.

By way of specific example, each barrier island 61 is egg-shaped having one end 61*a* that is of smaller radius than the other end 61*b*. By way of a more specific example, the end of smaller radius is closer to and faces the feed edge 11*a*. An egg-shaped barrier island 61 can have an axis of symmetry A (as shown in FIG. 3) that is orthogonal to the feed edge 11*a* and can be considered a major axis. The dimension W is therefore orthogonal to this axis of symmetry, and can be considered a width of the barrier island 61 as shown in this embodiment.

As another example, the barrier islands can be circular, as illustrated in FIG. 3 in phantom as barrier island 61', wherein the radius is selected as an approximate inverse function of shelf length. The shapes of the barrier islands, however, may vary according to application.

Generally, in this embodiment the size of the barrier island is selected as an approximately inverse function of the shelf length so as to control the hydraulic diameter of each of the channels 29*a*, 29*b* of the drop generators 40 in the group 156.

Figure 4A:
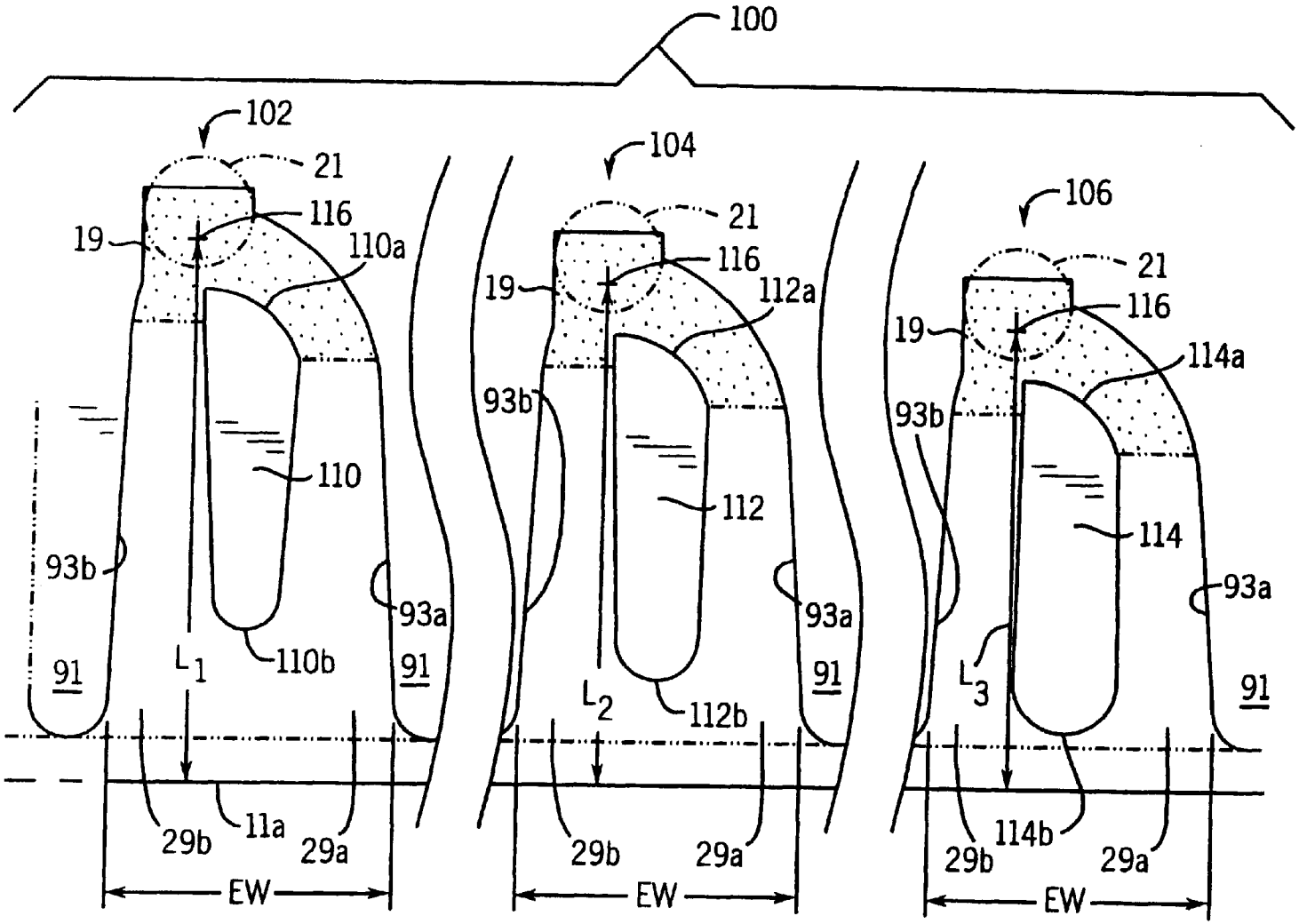
FIG. 4A is an unscaled schematic top plan view illustrating the configuration of a group of representative fluid chambers, feed channels, and barrier islands of a printhead in accordance with another embodiment of the present invention.
Figure 4B:
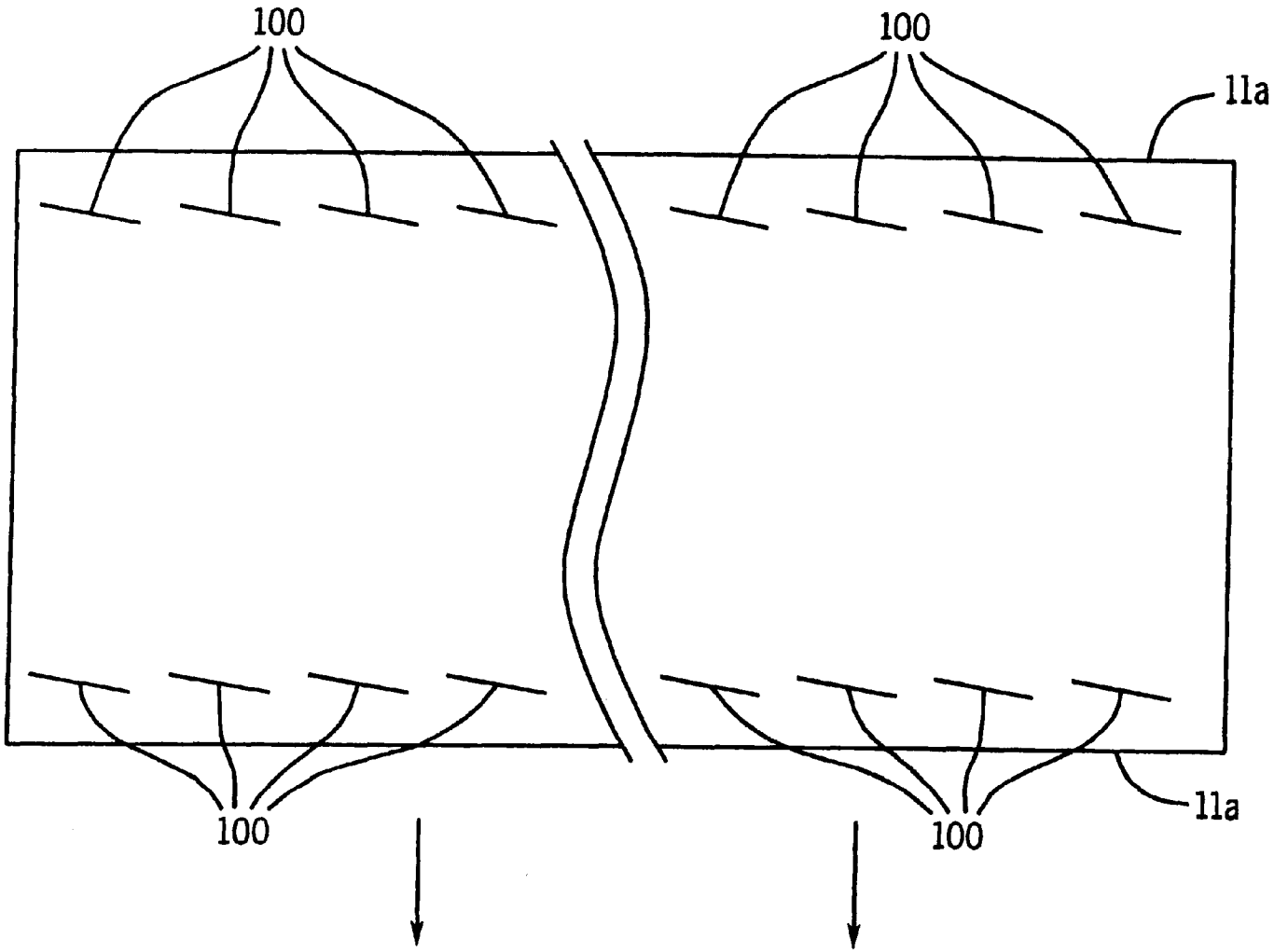
FIG. 4B is a plan view of an embodiment of a printhead illustrating groups of fluid drop generators.

In FIGS. 4A–7, another embodiment of the invention is shown. FIG. 4A presents a group 100 of drop generators 102, 104, 106. Each drop generator includes a respective fluid chamber 19 with two associated feed channels 29*a*, 29*b*, a barrier island 110, 112, 114, a resistor heater (not shown) and a nozzle 21 (shown in dotted lines), as discussed in detail more below. Similar to the embodiment shown in FIGS. 1–3, drop generators 102–106 each include a plurality of substantially circular nozzles 21 (shown in dotted lines) and heater resistors. Note that only the centers 116 of the heater resistors are shown in FIGS. 4A, 4B and 5–7 and they are represented by the symbol "+". In this embodiment, the group 100 shown is a condensed set, in that only 3 of 12 drop generators are shown, similar to FIG. 2 described above. In one embodiment, there are approximately 22 groups of fluid drop generators aligned adjacent the feed edge 11*a*. These 22 groups 100 (shown symbolically in FIG. 4B) are also duplicated along the opposing feed edge 11*a* in the embodiment illustrated. In one embodiment, individual groups 100 are substantially identical. Note, however, that any number of groups or drop generator per group may be used to achieve adequate and uniform firing in accordance with the invention.

Figures 5, 6, 7:
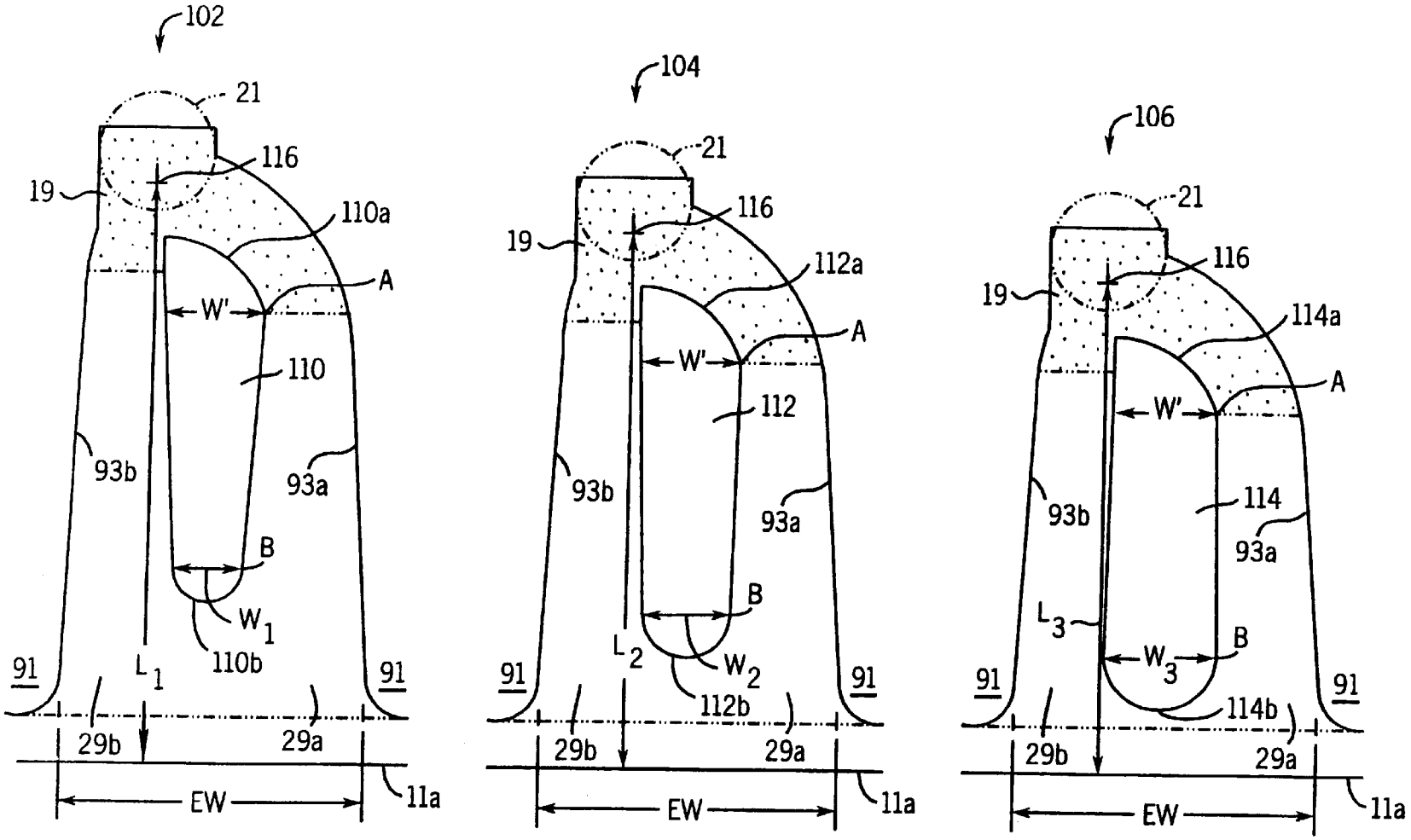
FIGS. 5–7 each illustrate an unscaled schematic top plan view of a representative fluid chambers, feed channels, and barrier islands shown in FIG. 4A.

In the embodiment of FIGS. 5 and 7, the extreme drop generator shelf lengths in the group 100 are shown, while FIG. 6 shows the average drop generator shelf length in the group 100. The drop generators 102–106 each include a fluid chamber 19 (stippled region) with the feed channels 29*a*, 29*b*. The feed channels 29*a*, 29*b* associated with the fluid chamber 19 are formed by the walls of the barrier protrusions 91 that extend from the regions between the resistors 56 toward the feed edge 11*a*, similar to the embodiment shown in FIGS. 1–3. Specifically, the barrier protrusion 91 includes opposing walls 93*a*, 93*b* that extend from resistor heaters toward the feed edge 11*a*. The walls 93*a*, 93*b* diverge away from each other to form the outer sides of the feed channels, which communicate with the fluid chamber 19 in the embodiment.

In this embodiment, the protrusions 91 between the drop generators 102, 104, 106 across group 100 are substantially the same shape and have substantially the same volume, as discussed below. In an additional embodiment of FIG. 4A, the distance EW between the portions of walls 93*a*, 93*b*, as measured parallel to the feed edge 11*a*, is substantially the same for all drop generators in group 100.

In the embodiment shown in FIGS. 4A, 4B and 5–7, as in the embodiment shown in FIGS. 1–3 (and FIG. 8), it is desired to equalize the fluidic pressure or resistance in the fluid chambers 19 to ensure that fluid (or ink) is adequately and uniformly fired from the nozzles 21. To this end, the drop generators 102, 104, 106 of the embodiment of FIGS. 5–7 also include barrier islands (represented as 110, 112, 114, respectively) located between opposing walls 93*a*, 93*b*. The representative barrier islands 110, 112, 114 and opposing walls 93*a*, 93*b*, respectively, define the feed channels 29*a*, 29*b*.

In the illustrated embodiment, the representative barrier islands 110, 112, 114 have certain uniform characteristics. The representative barrier islands 110, 112, 114 are asymmetrically shaped in the embodiment of FIG. 4A, but may be any desired shape. The upper portion (110*a*, 112*a*, 114*a*) of each island is shaped in the form of a quarter circle and the lower portion (110*b*, 112*b*, 114*b*) is shaped in the form of a half circle (with different diameters, however, as is explained below) in this embodiment. The upper portions 110*a*, 112*a*, 114*a* are uniform in cross-section with a constant width W', measured at point A (point on the right side at which the quarter circle terminates) to the left (generally straight side of barrier islands 110, 112, 114) in this embodiment. That is, the width W' at point A across the upper portions 110*a*, 112*a*, 114*a* of the barriers 110, 112, 114 is generally the same. W' is preferably about 23 microns in length in this embodiment. Each barrier island has a height that preferably extends substantially the distance between the thin film substructure 11 and the nozzle plate 13 in this embodiment. However, in an alternative embodiment the height of the barrier islands may vary to compensate for (heater resistor) nozzle stagger throughout the group 100.

In this embodiment, not all characteristics of the barriers 110, 112, 114 are the same, however. As shown in the embodiment of FIG. 5, the barrier island 110 has a body portion that tapers from the upper portion 110*a* toward the lower portion 110*b*. In this embodiment, the lower portion 110*b* of the barrier island 110 has a width $W_1$ (also the diameter of half circle) that is narrower than the width W' of the upper portion. In the embodiment of FIG. 6, the body of the barrier island 112 also tapers from the upper portion 112*a* toward the lower portion 112*b* thereof, but the body portion tapers more gradually than the FIG. 5 embodiment. In this average drop generator embodiment, the lower portion 112*b* of barrier island 112 has a width $W_2$ (which is also the diameter of the half circle) that is smaller than W' but greater than $W_1$.

The body portion of the barrier island 114 in the embodiment of FIG. 7 does not taper from the upper portion 114*a* inwardly toward the lower portion 114*b* thereof. Conversely, the body of the barrier island 114 actually widens, i.e., increases in width $W_3$ (which is also the diameter of the half circle) toward the bottom portion thereof. In this extreme embodiment, the width $W_3$ is greater than W', $W_1$ and $W_2$. The widths $W_1$, $W_2$, $W_3$ are measured at Point B (parallel to edge 11*a*) across the lower portions 110*b*, 112*b*, 114*b* of the barrier islands 110, 112, 114, the point at which the half circle shape is realized. The widths W', $W_1$, $W_2$ and $W_3$ of this embodiment are preferably about 23, 18, 22.32, 24.26 microns, respectively.

Similar to the embodiment shown in FIGS. 1A. 1B and 2–3, the barrier island width dimension ($W_1$, $W_2$ and $W_3$) in the embodiment of FIGS. 5–7 increases as the shelf length ($L_1$, $L_2$ and $L_3$) decreases. Consequently, the channel width of each of the associated channels 29*a*, 29*b* increases as the shelf length ($L_1$, $L_2$ and $L_3$) increase in this embodiment. Channel width is thus a direct function of shelf length. Effectively, the equivalent hydraulic diameter of each of the channels 29*a*, 29*b* is increased as channel length is increased to compensate for the different channel lengths, so that the fluidic resistances of the channels 29*a*, 29*b* for heater resistors positioned different shelf lengths away from the feed edge 119 can be substantially equalized in this embodiment.

In the embodiment shown in FIGS. 5–7, three of the different shaped barrier islands of the group 100 are shown. In one embodiment, a drop generator in the group has a differently shaped barrier island depending upon the corresponding shelf length L. In an alternative embodiment, any number of barrier island shapes may be used to achieve adequate and uniform firing. In addition, the shape of the representative barrier islands 110, 112, 114 (along with the shape of the fluid chambers 19 and feed channels 29*a*, 29*b*) are preferably asymmetrical as shown in the embodiment of FIGS. 5–7 and in contrast to FIGS. 1A, 1B and 2–3. In this embodiment, the asymmetrical shape creates a dominant channel that has a greater volume and less channel resistance than the other channel of the drop generator, which helps to increase the chances of adequate firing. In addition, it is the combination of the position of the upper portion of the barrier islands 110, 112, 114 (adjacent the fluid chambers 19, respectively) and the uniformity in size of those upper portions in this embodiment that ensures the volume (stippled region) in the fluid chamber 19 for each drop generator is substantially the same across the fluid chambers 19 in this embodiment.

Using the embodiment shown in FIGS. 4A, 4B, and 5–7, the pen frequency response of an printhead (such as an ink jet printhead) is considerably improved over variable heater/nozzle stagger. That is, in this embodiment the uniformity of the fluid (ink) drop weight increases regardless of the shelf length employed, which improves the print quality.

Figure 8:
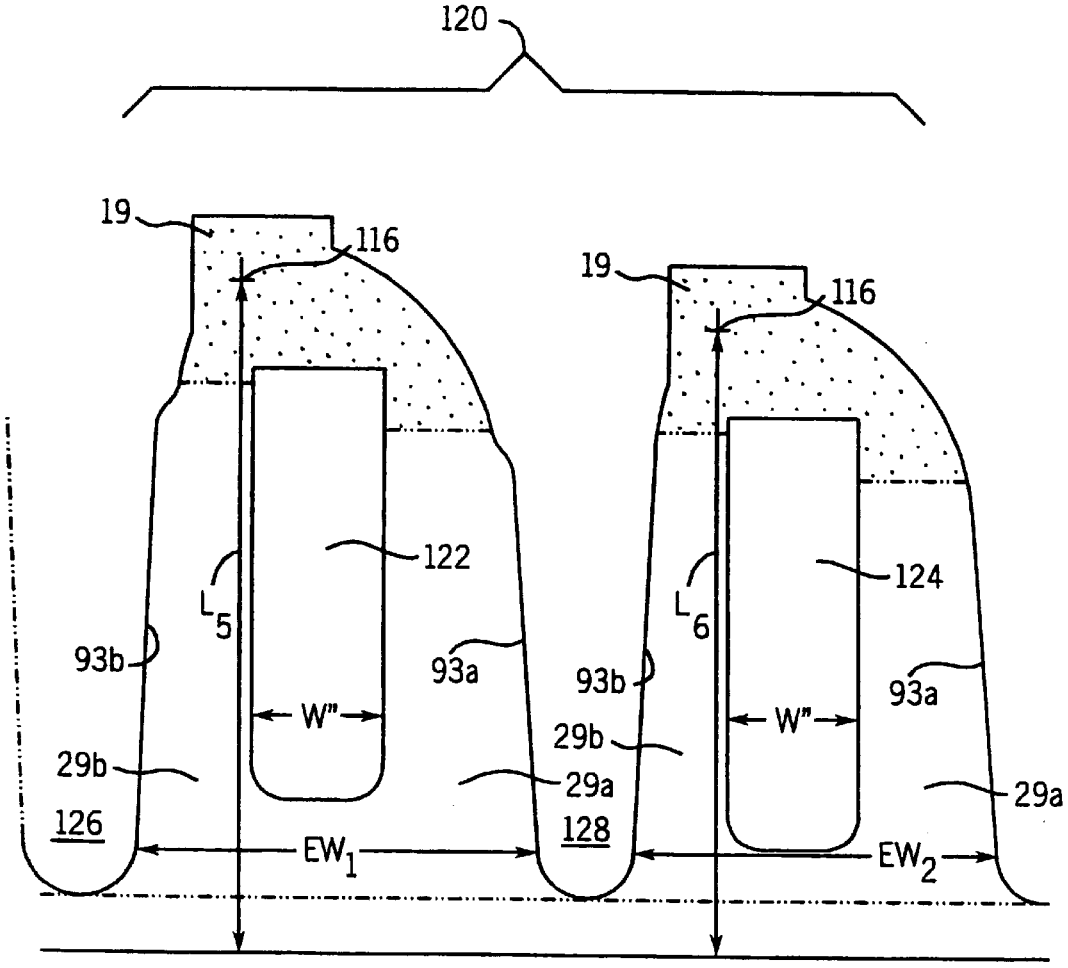
FIG. 8 is an unscaled schematic top plan view illustrating the configuration of a plurality of representative fluid chambers, feed channels, and barrier islands of a printhead in accordance with an alternative embodiment of the present invention.

Referring to FIG. 8, an alternative embodiment of the printhead incorporating the invention is shown. Although only two drop generators are shown, the group 120 includes additional variations for achieving adequate and uniform fluid (such as ink) firing from the nozzles (not shown) of the printhead (such as an ink jet printhead). Similar to the embodiment shown in FIGS. 1A, 1B and 5–7, the fluid chambers 19 of the group 120 have the same volume (stippled region) and the heater resistors (centers 116) and nozzles (not shown) are staggered. In this alternative embodiment, however, the barrier islands 122, 124 of the representative drop generators are substantially the same size, i.e., the widths W" are constant throughout the length of the barrier islands 122, 124. The barrier islands 122, 124 and the opposing walls 93*a*, 93*b*, respectively define channels that communicate with the fluid chambers 19, respectively.

In order to achieve uniform fluidic pressure or resistance in the chambers 19 to ensure that fluid is adequately and uniformly fired from the nozzles, in this embodiment, the widths of the channels 29*a*, 29*b* vary in size, i.e., they are selected generally as an inverse function of the shelf length of the respective drop generators. Consequently, the distance ($EW_1$ and $EW_2$) between the opposing walls (93*a*, 93*b*) varies as a function of the shelf length ($L_5$, $L_6$) of the respective drop generator. In a preferred embodiment, this is accomplished by varying the size of the protrusions 126 and 128 between the fluid chambers 19. In this embodiment, $EW_1$ is greater than $EW_2$. In a particular embodiment, $EW_1$ and $EW_2$ are approximately 70 and 60 microns in length, respectively. However, various measured values (for $EW_1$ and $EW_2$) may be used to compensate for (heater resistor) nozzle stagger, depending on the shelf length of the particular drop generator in the group.

In another exemplary embodiment, a method for ejecting fluid from a device is provided which comprises forming a plurality of fluid drop generators located at different distances from a feed edge. The plurality of fluid drop generators have a plurality of fluid regions for receiving fluid. Each region is defined by opposing walls. The method also comprises varying the volume of the plurality of fluid regions by varying the distance between the opposing walls, to thereby equalize fluidic pressure in the plurality of fluid regions.

Note that the embodiments described herein incorporate a fluid feed edge supply configuration. However, the invention may be utilized in embodiments that incorporate other fluid supply configurations such as a fluid slot configuration.

Fluidic pressure uniformity among the respective fluid chambers may also be achieved in alternative embodiments. For example, the barrier islands may be eliminated entirely in one embodiment. In this respect, the distance between opposing walls (or varying the width of the protrusions) may be varied to change the volume or region between the opposing walls (communicating with the fluid chambers) to compensate for the (resistor heater) nozzle stagger throughout the group.

Thus a barrier island structure for a fluid ejection device can provide for improved frequency response control and more consistent ink or fluid drop volume modulation.

Although the foregoing has been a description and illustration of specific embodiments of the invention, various modifications and changes thereto can be made by persons skilled in the art without departing from the scope and spirit of the invention as defined by the following claims.

What is claimed is:

1. A method of ejecting fluid from a device comprising:

forming a plurality of fluid drop generators including:

a plurality of heater elements located at different distances from a feed edge;

a plurality of fluid chambers disposed over the plurality of heater elements, respectively, each fluid chamber defined by opposing walls that extend toward the feed edge; and a plurality of barrier islands respectively associated with the plurality of fluid chambers, one of the plurality of barrier islands disposed between the opposing walls of each fluid chamber to define a pair of feed channels in each fluid chamber; and individually selecting the size of each of the plurality of barrier islands to substantially equalize fluidic resistances in the plurality of fluid chambers.

2. The method of claim 1, wherein a width of a portion of each barrier island is selected as a generally inverse function of the distance between the respective one of the plurality of heater elements and the feed edge.

3. The method of claim 1, wherein a width of one of the pair of feed channels increases as the distance between the respective one of the plurality of heater elements and the feed edge increases.

4. The method of claim 1, wherein each channel of the pair of feed channels has a hydraulic diameter that increases as its channel length increases.

5. The method of claim 1, wherein the plurality of barrier islands each are shaped substantially in the form of an egg.

6. The method of claim 1, wherein the barrier island of the plurality of barrier islands each are shaped substantially in the form of a circle.

7. The method of claim 1, wherein each of the plurality of barrier islands is substantially symmetrically shaped.

8. The method of claim 1, where each barrier island of the plurality of barrier islands is asymmetrically shaped, thereby creating a dominant channel in the pair of feed channels.

9. The method of claim 1, wherein each barrier island of the plurality of barrier islands includes an upper portion adjacent the respective heating element and a lower portion adjacent the feed edge.

10. The method of claim 9, wherein the lower portion is substantially shaped in the form of a half circle.

11. The method of claim 9, wherein the upper portion is substantially shaped in the form of a quarter circle.

12. The method of claim 9, wherein the lower portion of each barrier island has a width that decreases as the distance between the respective heater element and the feed edge increases.

13. The method of claim 1, wherein at least one barrier island of the plurality of barrier islands narrows toward a heater resistor.

14. The method of claim 1, wherein at least one barrier island of the plurality of barrier islands narrows toward the feed edge.

15. The method of claim 1, wherein the size of each of the plurality of barrier islands is inversely proportional to the distance between the respective heater element and the feed edge.

16. A method of ejecting fluid from a device comprising:

forming a plurality of fluid drop generators located at different distances from a feed edge, the plurality of fluid drop generators having a plurality of fluid regions that receive fluid and a plurality of barrier islands disposed within the fluid regions, respectively; and varying the volume of the plurality of fluid regions by varying the size of each of the plurality of barrier islands to thereby equalize fluidic pressure throughout the plurality of fluid regions.

17. The method of claim 16, wherein varying the volume includes selecting the width of each of the plurality of barrier islands, at one point there along, as a generally inverse function of the distance between the respective fluid drop generator and the feed edge.

18. A fluid ejecting device comprising:

a substrate having a feed edge and a plurality of heater elements located at different distances from the feed edge;

a barrier layer having a plurality of fluid chambers disposed over the plurality of heater elements, respectively, the plurality of fluid chambers each defined by opposing walls that extend toward the feed edge; and a plurality of barrier islands respectively associated with the plurality of fluid chambers, one of the plurality of barrier islands disposed between the opposing walls of each fluid chamber, the plurality of barrier islands each have a size that is inversely proportional to the distance between the respective heater element and the feed edge.

19. The device of claim 18, wherein at least one barrier island of the plurality of barrier islands has a lower portion and an upper portion that is wider than the lower portion.

20. The device of claim 19, wherein the upper portion has a shape substantially in the form of a quarter circle.

21. The device of claim 20, wherein the lower portion has a shape substantially of a half circle.

22. The device of claim 18, wherein the plurality of barrier islands have first portions that are each uniform in cross section.

23. The device of claim 18, wherein a width of a portion of each barrier island is selected as a generally inverse function of the distance between each of the plurality of resistor elements, respectively, and the feed edge.

24. The device of claim 18, wherein each barrier island and the opposing walls of each fluid chamber define a pair of channels, and wherein a width of one of the pair of channels increases as the distance between the plurality of heater elements and the feed edge increases.

25. The device of claim 24, wherein each channel of the pair of channels has a hydraulic diameter that increases as its channel length increases.

26. The device of claim 18, wherein each barrier island and the opposing walls define a pair of channels, and wherein each of the barrier islands are asymmetrically shaped, thereby creating a dominant channel as one of the pair of channels.

27. The device of claim 18, wherein each barrier island of the plurality of barrier islands have an upper portion adjacent each respective fluid chamber and a lower portion adjacent the feed edge, and wherein the distance between the respective heater element and the feed edge increases as the width of the lower portion decreases.

28. The device of claim 18, wherein the opposing walls of each respective fluid chamber diverge away from one another toward the feed edge.

29. The device of claim 18, wherein the distance between opposing walls, defining the plurality of fluid chambers, remains constant for each respective fluid chamber.

* * * * *